US005845347A

United States Patent [19]

Young

[11] Patent Number: 5,845,347

[45] Date of Patent: Dec. 8, 1998

[54] METHOD OF MANUFACTURING SHOWER FOUNDATION

[76] Inventor: David A. Young, 303 Vine St., Denver, Colo. 80206

[21] Appl. No.: 715,601

[22] Filed: Sep. 18, 1996

Related U.S. Application Data

[63] Continuation-in-part of Ser. No. 398,773, Mar. 6, 1995, abandoned.

[51] Int. Cl.[6] ..... A47K 3/04

[52] U.S. Cl. ..... 4/613

[58] Field of Search ..... 4/584, 612, 613; 52/265, 389, 741.4

[56] References Cited

U.S. PATENT DOCUMENTS

| | | | |
|---|---|---|---|
| 2,197,874 | 4/1940 | Myers | 4/613 |
| 2,239,969 | 4/1941 | Morthland | 4/613 X |
| 2,484,240 | 10/1949 | Morthland | 4/613 |
| 3,457,568 | 7/1969 | Amatruda | 4/613 |
| 3,675,384 | 7/1972 | Knecht | 52/250 |
| 4,557,004 | 12/1985 | Piana | 4/613 |
| 4,694,513 | 9/1987 | Kiziah | 4/288 |
| 4,993,201 | 2/1991 | Bunyard | 52/35 |
| 5,092,002 | 3/1992 | Powers | 4/596 |
| 5,371,980 | 12/1994 | Dix | 52/34 |

*Primary Examiner*—Robert M. Fetsuga
*Attorney, Agent, or Firm*—Fields and Johnson, P.C.

[57] ABSTRACT

A method of manufacturing a shower foundation is disclosed. A base including a curb portion is formed by injection molding. A waterproof membrane is sprayed over the base. The membrane includes three vertical extensions which are contiguous with a flat portion of the membrane. A backer layer is placed over the waterproof membrane, the backer layer being made of a flexible sheet material. A drain is formed through the base and is sealed with respect to the backer layer and waterproof membrane. A threshold is made by the addition of a lip formed over the curb portion of the base. A method is also disclosed for installing the shower foundation made by the method of manufacturing. The installing method includes the steps of sliding the shower foundation into a space designated for a shower unit, attaching the waterproof membrane of the shower foundation to studs surrounding the space, installing walls of the shower unit on the base, and securing the shower walls to the studs. Tile may then be directly mounted on the shower walls and base.

1 Claim, 2 Drawing Sheets

METHOD OF MANUFACTURING SHOWER FOUNDATION

This application is a continuation in part of U.S. application Ser. No. 08/398,773 filed Mar. 6, 1995, abandoned entitled "Shower Base Designed as Tile Foundation and Method for Manufacturing".

TECHNICAL FIELD

This invention relates to a method of manufacturing a shower foundation that is used in bathrooms, and a method of installing the same.

BACKGROUND ART

A number of prior art references exist which disclose improved shower foundations with a goal of providing structurally simple foundations and providing flexibility in design allowing easier installation of the shower foundation at a job site.

One example of a prior art reference is U.S. Pat. No. 4,557,004 to Piana which discloses a prefabricated shower module including low side walls and a front wall which has a horizontal outward projecting lip. Outwardly facing edges of the side walls are adapted to mate with wallboards forming inner upper walls of the shower enclosure. The use of the shower module enables workmen to more readily install a shower enclosure that is both watertight and has true and plumb surfaces.

U.S. Pat. No. 5,371,980 to Dix discloses a shower liner for use with ceramic tile consisting of a shell constructed of a polymer plastic body having a substantially flat bottom and a peripheral side wall extending upwardly from the bottom. A recessed channel is positioned adjacent the bottom of the shell accommodating any framing defect at floor level which might otherwise cause difficulty for installing the shower liner. A raised convex pierceable member is positioned on the bottom of the shell and which indicates a preferred position of a drain to be installed therethrough.

U.S. Pat. Nos. 2,239,969 and 2,484,240 to Morthland both disclose a shower pan construction. In the first reference, the shower pan is made up of a composition of layers of flexible material including a layer of roofing felt and a layer of craft paper. As for the second reference, the shower pan construction includes a cement box having an intermediate layer of water impervious material which is positioned between interior and exterior edges of the box.

U.S. Pat. No. 5,092,002 to Powers discloses a shower base including a floor, a drain formed in the center thereof and a lower water retaining wall extending along at least a portion of the floor of the shower base. The water retaining wall includes an inclined insert having an inner wall adapted to be positioned adjacent the floor of the shower. The upper surface of the inclined insert is inclined downwardly in the direction of the floor of the shower.

U.S. Pat. No. 3,675,384 to Knecht discloses flooring construction which may be used as original installation or in the repair of leaking shower stalls. The floor construction comprises a metal angle placed at the bottom of the shower stall walls and succeeding layers of asphalt mastic, waterproof fibrous material, wire lath, mortar and tile.

U.S. Pat. No. 2,197,874 to Myers discloses a receptor for shower stalls comprising a bottom member having four integral upstanding side walls which are continuous around the receptor. The bottom member further includes an insulating member to keep the receptor at a substantially constant temperature and rubber matting to provide a slip-proof tread or floor covering over the bottom member. A drain is provided centrally of the receptor allowing water to drain therethrough.

U.S. Pat. No. 3,457,568 to Amatruda teaches a shower receptor comprising a bottom wall having a circumscribing upright end wall, and further having a drain opening arranged to drain over a supporting slot. Operatively associated with the drain opening is a chamber defining a gas trap having a partition depending from a wall portion thereof and extending into a water level to separate the gas chamber from the water in that portion thereto.

While each of the foregoing references may disclose a certain improvement in the construction of a shower foundation, each of the references has definable drawbacks in that they are either difficult to install, are structurally complex, or do not provide the proper combination of materials which ensures the shower foundation will remain waterproof and structurally sound over a long period of time. Furthermore, some of the references disclose shower foundations which are difficult to install.

Each of the foregoing disadvantages of the prior art can be overcome by providing improved methods of manufacturing and installing a shower foundation as disclosed herein.

DISCLOSURE OF THE INVENTION

According to this invention, a method is provided to manufacture a shower foundation and to install the same into a bathroom or other area requiring a shower unit. The method of manufacturing the shower foundation begins with the formation of a base including an integral curb by injection molding. A mold is provided which is filled with a highly durable resin material. Prior to the injection, a lower drain portion is supported in the mold whereby after the injection molding takes place, the lower drain portion is integrally formed with the base.

After formation of the base with integral curb and lower drain portion, a waterproof membrane is formed over the base by spraying a liquid material thereon and allowing the liquid material to dry. The waterproof membrane includes three vertical extensions which are contiguous with a flat portion of the waterproof membrane covering the base. Furthermore, the membrane is also applied continuously over the curb portion of the base. Accordingly, the waterproof membrane is one continuous unit which has no seams or breaks and completely covers the base.

A flexible backer layer, in the form of flexible precut sheets, is then placed over the flat portion of the waterproof member covering the base. These flexible precut sheets may be composed of, for example, sheets of Durock® or Wonderboard®. An upper drain portion is attached to the lower drain portion, the upper drain portion being substantially level with the top edge of the backer layer. When the upper drain portion is positioned and attached to the lower drain portion, corresponding flanges of the upper and lower drain portions sandwich therebetween the waterproof membrane which has been applied over the lower drain portion. Accordingly, a watertight seal is created between the connecting upper and lower drain portions.

A lip is formed over the curb of the base by an appropriate material such as mortar which is placed in a mold covering the curb. When the mortar dries, the mold is removed thus forming the lip. The combination of the curb with the overlying lip forms the threshold of the shower foundation.

Since the flexible precut sheets forming the backer layer are flexible, they can be bent to conform to a desired slope which enables the shower foundation to properly drain. Furthermore, the waterproof membrane is applied over the base which has its own slope to accommodate the drainage of any water which may seep through the backer layer. A plurality of weep holes formed on the flange of the lower drain portion communicate with the main aperture of the drain and the upper surface of the waterproof membrane enabling any seepage of water to be removed from the shower foundation through the drain.

When assembled, the shower foundation can be directly installed into space formed as a shower stall or alcove. To install the shower foundation at a job site, the base is placed directly on the subfloor of the shower alcove and the three vertical extensions of the waterproof membrane are secured to the studs of the shower alcove. Then, an appropriate waterproof shower stall lining is applied upwardly of the three vertical extensions in the shower alcove and secured against the shower alcove studs. Next, the walls of the shower stall can be emplaced directly upon the peripheral edges of the base, interiorly of the shower stall lining, and secured to the shower alcove studs. Finally, the tiles of the shower may be placed directly upon the backer layer and the shower walls.

Providing a prefabricated shower foundation eliminates the need for the services of a skilled artisan such as a tiler who must create a shower foundation base by pouring mortar or the like into a form at the job site. Furthermore, constructing the shower foundation at the job site requires wait time for the shower foundation base to cure and requires the artisan to return to the job site a number of times to construct the constituent layers of the shower foundation mounted on the base.

The continuous and seamless waterproof membrane completely seals the shower foundation with respect to the subfloor on which it is mounted and with respect to the surrounding shower stall walls.

These and other advantages are disclosed in the following description.

DETAILED DESCRIPTION OF THE DRAWINGS

Figure 1:
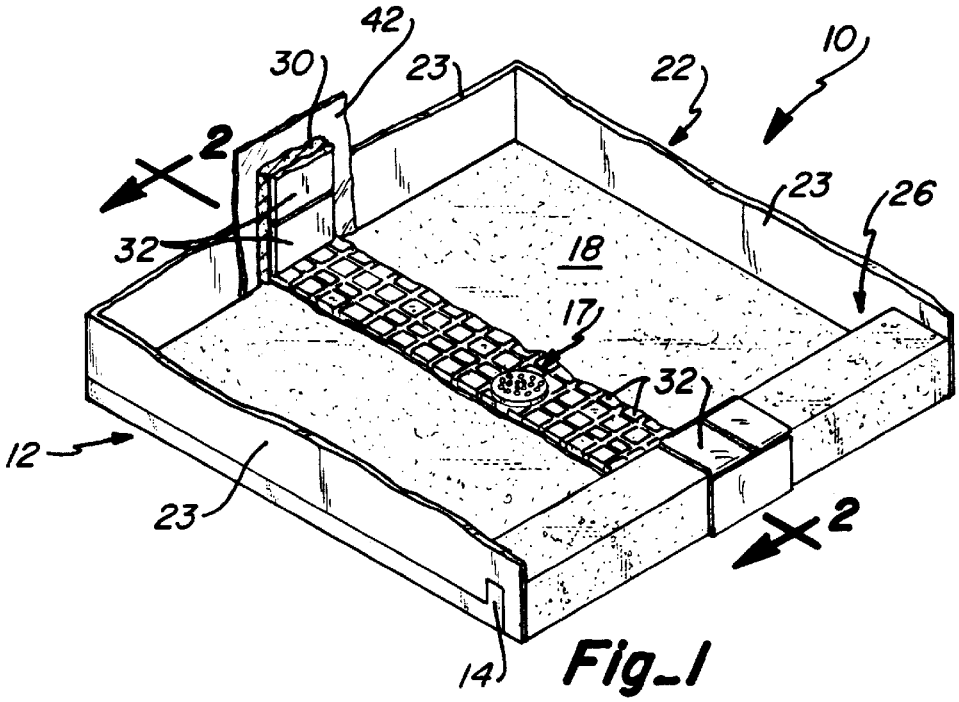
FIG. 1 is a perspective view of the shower foundation constructed in accordance with the method of manufacturing of this invention and FIG. 1 also illustrates a fragmentary section of tile mounted to the shower foundation and a fragmentary section of a shower wall.
Figure 2:
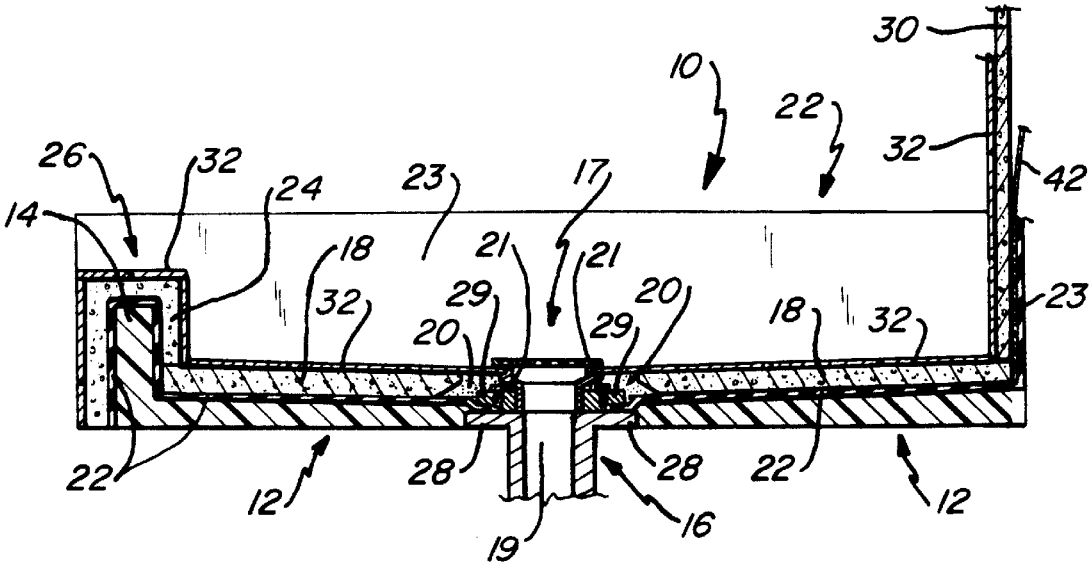
FIG. 2 is a vertical section, taken along line 2—2 of FIG. 1, showing the internal details of the shower foundation constructed in accordance with the method of manufacturing of this invention, and FIG. 2 also illustrates the shower foundation as installed adjacent a shower wall, and tile covering the shower wall, threshold, and backer layer.

As shown in FIGS. 1 and 2, an improved prefabricated shower foundation 10 may be manufactured which enables the shower foundation 10 to be more easily installed within the shower alcove of a home or other building structure requiring a shower unit.

The first step in the method of manufacturing the shower foundation 10 is to make the base 12 which includes integral curb 14. The base is made by an injection molding process wherein a synthetic resin or other appropriate material is injected into a base mold (not shown) having the shape of the base 12. The base may be made of a material such as urethane which is resilient to stress and is lightweight. A lower drain portion 16 is secured within an opening of the base mold and becomes secured to the base 12 during the injection molding process wherein the injected resin flows into the base mold and surrounds the lower drain portion 16.

After formation of the base 12 including vertical curb 14, a waterproof membrane 22 may be formed by spraying a liquid synthetic rubber over the base 12 and along three vertical mold walls (not shown) which serve as molds to form vertical extensions 23 of the waterproof membrane 22. After the waterproof membrane has dried, the vertical mold walls are removed and the waterproof membrane takes its solid form including the three vertical extensions 23. By the use of a synthetic rubber which is sprayed over the base 12, the waterproof membrane is continuous with no breaks or seams. Furthermore, there is no folding or otherwise any physical alteration that needs to be made to the waterproof membrane 22 prior to emplacing the backer layer 18 thereover. Even when a continuous sheet of solid waterproof material is used as a substitute for the waterproof membrane, as in the prior art, the solid sheet can be damaged by the creation of folds or creases that must be made in order that solid sheets conform to the shape of the base. That is, solid sheets can become prematurely stressed over time by the folds and creases which damage the integrity of the solid sheet.

In order to complete the drain structure of the shower foundation, an upper drain portion 17 is attached to the lower drain portion 16 as by bolts 21. The upper and lower drain portions when attached form main drain aperture 19. When the upper drain portion 17 is attached to the lower drain portion 16, the waterproof membrane 22 at the location of the lower drain portion 17 is sandwiched between flange 29 of upper drain portion 17 and flange 28 of lower drain portion 16.

Sometime after the formation of the waterproof membrane 22, backer layer 18 may be positioned over the waterproof membrane 22. Backer layer 18 may be made of a plurality of sheets of flexible material such as Durock® or Wonderboard®. The Durock® or Wonderboard® is essentially made of mortar material which is sandwiched between two layers of backing material. Thus, the Durock® or Wonderboard® has the same characteristics as a poured mortar, however, the Durock® or Wonderboard® also is capable of being bent to conform to a sloped surface because the backing material provides some flexure whereas poured mortar cannot flex without cracking once it has dried. After the backer layer 18 has been applied over the waterproof membrane 22, mortar 20 may be placed between the outside edges of the upper drain portion 17 and the protruding edges of backer layer 18 to ensure that there is a continuous seal around the exterior of upper drain portion 17.

Sometime after the emplacement of the backer layer 18 over the waterproof membrane 22, lip 24 may be formed over curb 14 by placing a lip mold (not shown) thereover and filling the lip mold with mortar or other appropriate construction material which provides strength and rigidity to the curb 14. Once the mortar has dried the lip mold is removed. The combination of curb 14 and lip 24 comprise the threshold 26 of the shower foundation 10.

Figure 3:
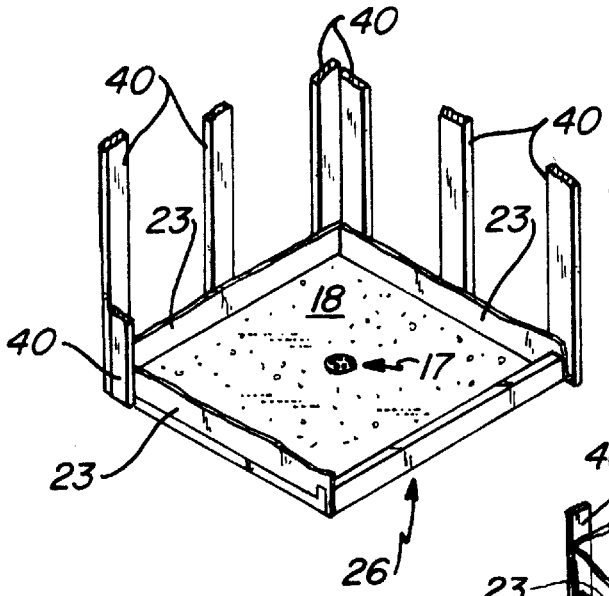
FIG. 3 is a fragmentary perspective view of one step in the installation of the shower foundation in accordance with the method of installation of this invention.
Figure 4:
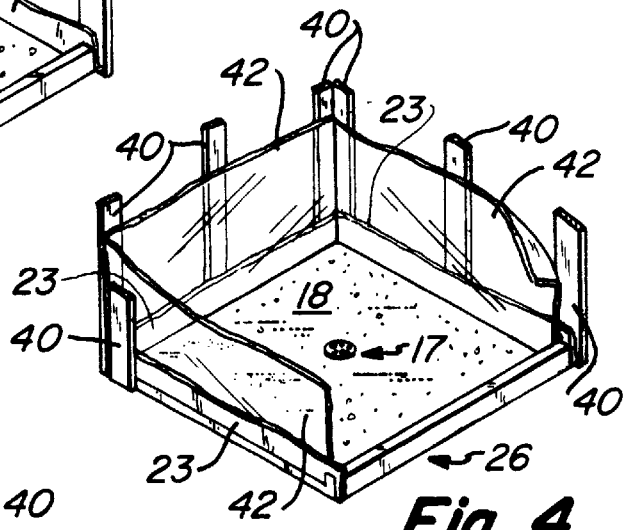
FIG. 4 is a fragmentary perspective view, as shown in FIG. 3, illustrating another step in the installation of the shower foundation.
Figure 5:
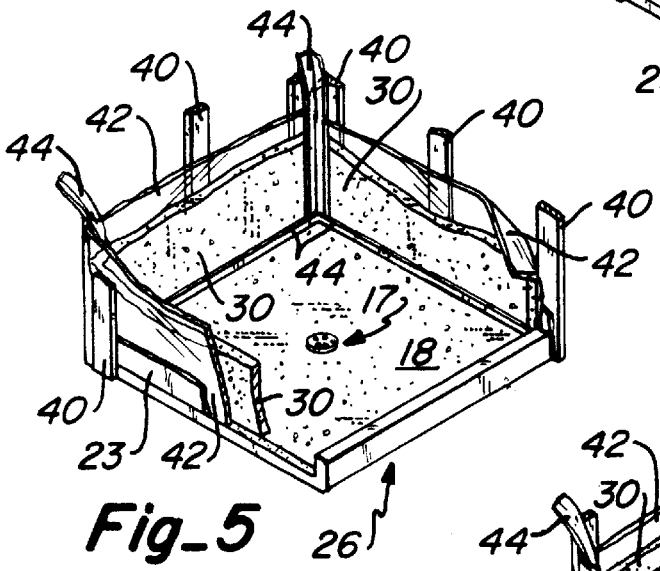
FIG. 5 is another fragmentary perspective view, as shown in FIGS. 3 and 4, showing another step in the installation of the shower foundation.
Figure 6:
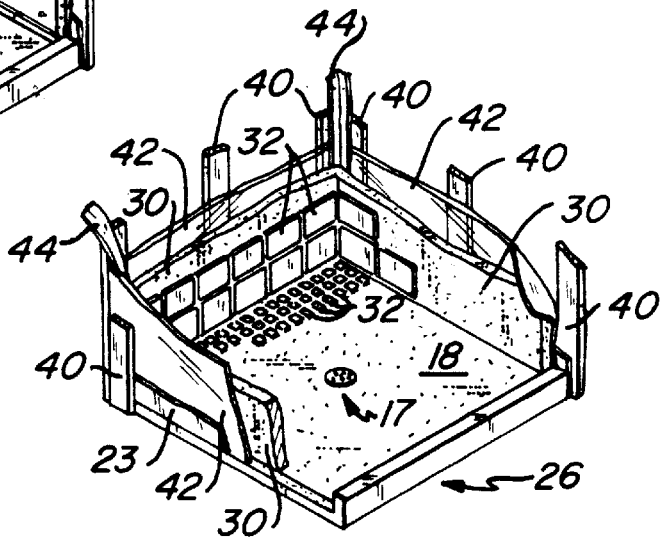
FIG. 6 is yet another fragmentary perspective view, as shown in FIGS. 3–5, illustrating another step in the installation of the shower foundation.

The method of installing the shower foundation 10 is shown in FIGS. 3–6. As shown in FIG. 3, the shower foundation 10 is installed between the studs 40 of the space designated as the shower alcove. Because of the light weight of the shower foundation 10, it may be easily placed into position between the studs 40. As shown in FIG. 4, once the shower foundation 10 is placed within the shower alcove, plastic lining 42 or another appropriate waterproof lining material may be attached to the studs 40 and over the vertical extensions 23 of the waterproof membrane 22 which are also secured to the studs 40. As shown in FIG. 5, the shower walls 30 may then be placed directly upon the peripheral edges of backer layer 18 and secured to studs 40. Mesh tape 44 may be placed along the joints formed between the bottom edges of the walls 30 adjacent the peripheral edges of backer layer 18, and along the joints formed between discrete sections of the walls 30 in order to provide smooth transitions and reinforcement between the walls and the shower foundation for which to mount tile 32. Typically, shower walls 30 may be made of the same material as backer layer 18. Lastly, the tile 32 may be secured directly upon backer layer 18 and walls 30 as by an appropriate grout and/or cement.

By creating a prefabricated shower foundation away from the job site on which it will be installed, unnecessary delays at the job site can be eliminated in terms of the wait time that would otherwise be required to construct the shower foundation at the job site. Specifically, making the shower foundation at the job site would require a skilled artisan to form the shower foundation from a mortar which requires time for the mortar to cure. Additional time is then also required in emplacing a waterproof membrane and the surface layer which overlies the waterproof membrane. Each of these wait times can result in a delay of the overall construction time at a job site. Furthermore, by incorporating a spray-applied continuous waterproof membrane, the membrane will not suffer from undue stresses which are typically experienced by prior art membranes which must either be folded, cut or otherwise altered in shape to conform to the shape of the shower foundation base.

The flexibility of the backer layer enables it to easily conform to a desired slope for drainage. In prior art devices, the layer above the waterproof membrane is typically not flexible after installation, and unnecessary cracking or degradation of the layer can occur due to the inability of standard mortar or concrete making up the layer to absorb tension stress produced, for example, by temperature variances. That is, while mortar and concrete are very durable in terms of compressive strength, any tension that might be introduced due to changes in temperature of the shower stall or other tension forces introduced, can create cracking of the layer which overlies the waterproof membrane. Such cracking then results in undesirable leakage of moisture directly to the waterproof membrane which itself may have become damaged. Ultimately, the damage to the waterproof membrane and the overlying layer can result in leakage of moisture onto the subfloor of the shower alcove.

An additional advantage in the methods of manufacture and installation of this invention is the use of the injection molded urethane for the base construction. Because the material is rigid and lightweight, it is easily transported and can be more easily maneuvered at the job site. Urethane will not crack or otherwise degrade due to stresses and strains induced by temperature changes within a shower stall. Furthermore, since urethane can be used in injection molding, differing base shapes can be more easily produced.

Lastly, the shower foundation manufactured according to the method of this invention enables an efficient and cost effective construction of a shower unit which includes tiled surfaces. Although the installation of a shower unit can be easily achieved by the use of one piece shower units which are constructed of one molded piece of plastic or the like, such shower units do not provide the luxury of tiled shower units which may be found in more luxurious settings.

The methods of this invention have been described in detail with reference to particular steps thereof, but it will be understood that various other modifications to the methods can be effected within the spirit and scope of this invention.

I claim:

1. A method of manufacturing a shower foundation for use in a shower unit, said method comprising the steps of:

forming a base, including a curb portion, and a lower drain portion attached to the base;

spraying a waterproof material over the base to form a waterproof membrane;

positioning an upper drain portion in connection with the lower drain portion thereby;

sandwiching the waterproof membrane therebetween;

placing sheets of flexible material over the waterproof membrane;

sealing the backer layer against the upper drain portion as by mortar; and forming a lip over the curb portion of the base to form a threshold.

* * * * *